US008651071B2

(12) United States Patent
Kamada

(10) Patent No.: US 8,651,071 B2
(45) Date of Patent: Feb. 18, 2014

(54) VARIABLE COMPRESSION RATIO ENGINE CONTROL APPARATUS

(75) Inventor: Shinobu Kamada, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 13/410,125

(22) Filed: Mar. 1, 2012

(65) Prior Publication Data

US 2013/0055990 A1 Mar. 7, 2013

(30) Foreign Application Priority Data

Apr. 15, 2011 (JP) ..... 2011-090736

(51) Int. Cl.
*F02B 75/04* (2006.01)

(52) U.S. Cl.
USPC ..... 123/48 R; 123/48 B; 123/78 B

(58) Field of Classification Search
USPC ..... 123/78 R, 48 R, 48 B
See application file for complete search history.

(56) References Cited

U.S. PATENT DOCUMENTS

| | | | | |
|---|---|---|---|---|
| 5,595,146 | A * | 1/1997 | Bollig et al. | 123/48 B |
| 6,530,862 | B2 * | 3/2003 | Kolmanovsky | 477/203 |
| 7,047,917 | B2 * | 5/2006 | Akihisa et al. | 123/48 R |
| 7,267,087 | B2 * | 9/2007 | Glugla | 123/48 R |
| 7,802,544 | B2 * | 9/2010 | Kamada | 123/78 F |

FOREIGN PATENT DOCUMENTS

| | | |
|---|---|---|
| JP | 2005-030223 | 2/2005 |
| JP | 2006-052682 | 2/2006 |
| JP | 2009-250163 | 10/2009 |
| JP | 2011-106370 | 6/2011 |
| WO | WO2011/067865 | 6/2011 |

OTHER PUBLICATIONS

European National Phase Application of the International Application No. PCT/JP2009/070717 as filed on Mar. 29, 2012.
The extended European Search Report for corresponding European Application No. 12157380.2-2311, dated Jun. 27, 2012.

* cited by examiner

*Primary Examiner* — Lindsay Low
*Assistant Examiner* — Syed O Hasan
(74) *Attorney, Agent, or Firm* — Global IP Counselors, LLP

(57) ABSTRACT

A variable compression ratio engine control apparatus includes a fuel injection device, a variable compression ratio device, a target compression ratio setting section and a compression ratio controlling section. The fuel injection device injects fuel into an engine for combustion. The variable compression ratio device varies an engine compression ratio of the engine. The target compression ratio setting section sets a target compression ratio. The compression ratio controlling section controls the engine compression ratio toward the target compression ratio. The target compression ratio setting section sets the target compression ratio based on an engine rotational speed, during a fuel cut operating state in which fuel injection by the fuel injection device is stopped.

7 Claims, 11 Drawing Sheets

(A) HIGH COMPRESSION RATIO POSITION (B) LOW COMPRESSION RATIO POSITION

VARIABLE COMPRESSION RATIO ENGINE CONTROL APPARATUS

CROSS-REFERENCE TO RELATED APPLICATIONS

This application claims priority to Japanese Patent Application No. 2011-090736, filed on Apr. 15, 2011. The entire disclosure of Japanese Patent Application No. 2011-090736 is hereby incorporated herein by reference.

BACKGROUND

1. Field of the Invention

The present invention generally relates to an engine control for a variable combustion ratio engine control apparatus or method for varying an engine compression ratio.

2. Background Information

Currently, some conventional engines are provided with a variable compression ratio control that varies the engine compression ratio. For example, a variable compression ratio engine control apparatus is disclosed in Japanese Laid-Open Patent Publication No. 2005-30223 that utilizes a piston-crank mechanism having a plurality of links. With the technology presented in that publication, a fuel cut control is executed to stop fuel injection during a deceleration operating state. Additionally, fuel injection is resumed when the engine rotational speed reaches a recovery rotational speed during the fuel cut state. Handling the resumption of fuel injection in this manner serves to avoid stoppage of the engine and ensure starting stability when the engine is restarted again after the fuel cut. The engine torque differs depending on the engine compression ratio, and the starting stability when the engine is restarted again also differs depending on the engine compression ratio. Therefore, the aforementioned recovery rotational speed is varied according to the engine compression ratio.

SUMMARY

The engine compression ratio for improving engine operating performance factors such as fuel efficiency and output performance is different during a normal engine operating state in which fuel is being injected and the torque id outputted from the engine than during a fuel cut operating state in which fuel injection is stopped (such as when the vehicle is decelerating). During a fuel cut operating state, setting a target compression ratio in the same manner as during a normal operating state or to a prescribed value does not sufficiently increase the engine operating performance and leaves room for improvement.

For example, during a deceleration operating state in which a fuel cut is executed, a prescribed engine braking occurs due to a pumping loss. In such a case, reducing the engine compression ratio suppresses a compression pressure and suppresses the pumping loss. Thus, by executing a control that utilizes an amount of energy corresponding to the suppressed pumping loss to regeneratively operate, for example, an alternator (generator) so as to generate electric power, a prescribed engine braking can be accomplished while effectively recovering energy that would otherwise be wasted, thereby improving fuel efficiency. Also, during a coasting operating state, which is a deceleration operating state in which a fuel is cut and the vehicle is travelling due to inertia with the accelerator pedal released, the engine compression ratio can be reduced to alleviate or suppress an excessive deceleration torque (engine braking). In this way, the fuel efficiency is improved and coasting distance is extended. However, if the engine compression ratio is excessively lowered during such fuel cut operating states, then there will be a possibility that when, for example, the engine rotational speed is low, ignition and combustion cannot be accomplished satisfactorily due to a low effective compression ratio and the combustion will be unstable.

The present invention was conceived in view of the circumstances just explained. One object presented herein is to appropriately control an engine compression ratio during an operating state in which a fuel cut is executed such that stable combustion can be ensured during restarting of the engine is after the fuel cut operation such that fuel efficiency can be improved during the operating state in which the fuel cut is executed.

In view of the state of the known technology, one aspect of the present disclosure is to provide a variable compression ratio engine control apparatus that basically comprises a fuel injection device, a variable compression ratio device, a target compression ratio setting section and a compression ratio controlling section. The fuel injection device injects fuel into an engine for combustion. The variable compression ratio device varies an engine compression ratio of the engine. The target compression ratio setting section sets a target compression ratio. The compression ratio controlling section controls the engine compression ratio toward the target compression ratio. The target compression ratio setting section sets the target compression ratio based on an engine rotational speed, during a fuel cut operating state in which fuel injection by the fuel injection device is stopped.

BRIEF DESCRIPTION OF THE DRAWINGS

Referring now to the attached drawings which form a part of this original disclosure.

DETAILED DESCRIPTION OF EMBODIMENTS

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

Figure 1:
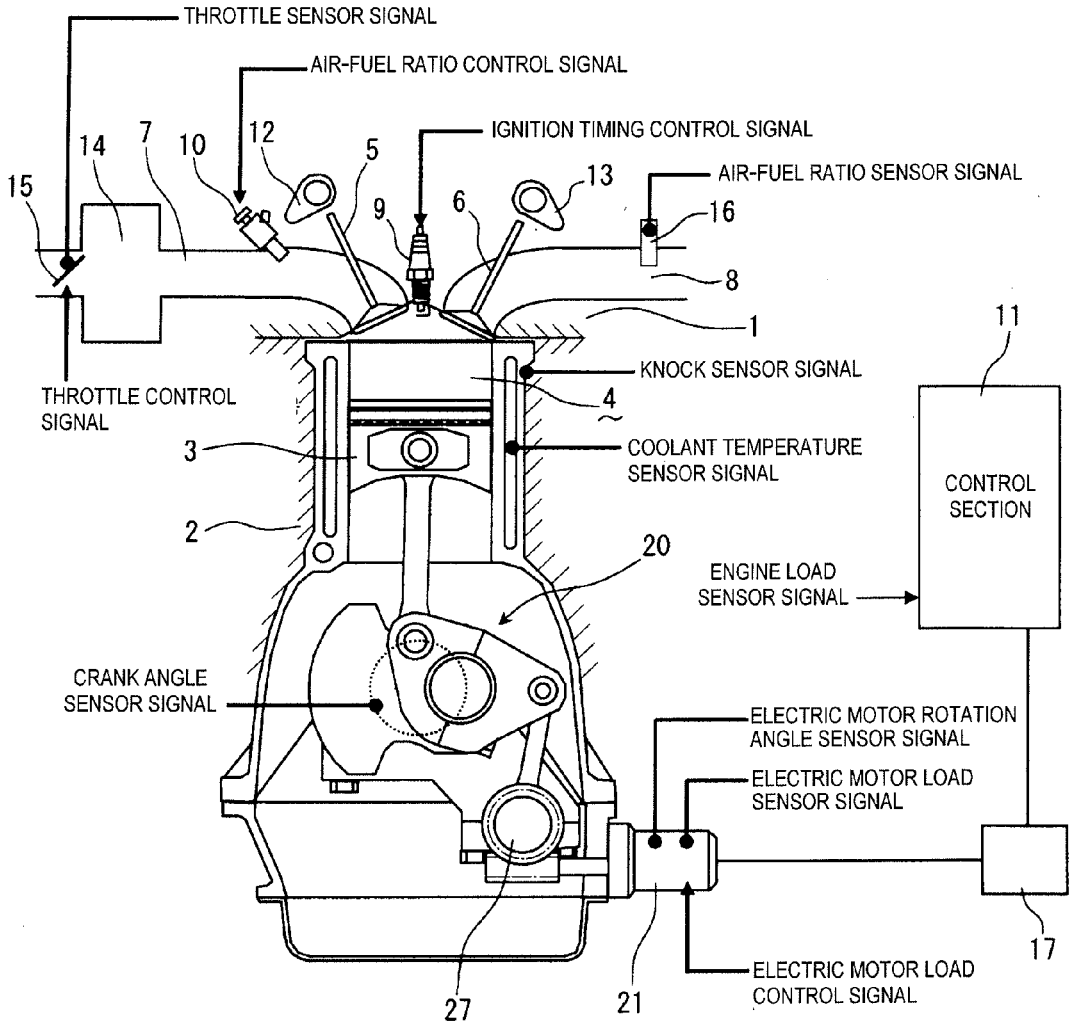
FIG. 1 is a schematic system diagram of a portion of a variable compression ratio engine that is equipped with a variable compression ratio engine control apparatus in accordance with a first embodiment.

Referring initially to FIG. 1, a spark ignition type of internal combustion engine is illustrated that is equipped with a variable compression ratio engine control apparatus in accordance with a first embodiment. The internal combustion engine can be other type of gasoline engine as needed and/or desired. As explained below, the variable compression ratio engine control apparatus controls a variable compression ratio engine by setting a low target compression ratio based on an engine rotational speed such that during a deceleration operating state in which a fuel cut is executed, combustion stability is ensured when the engine is restarted after the fuel cut. In particular, by keeping the target compression ratio low based on an engine rotational speed, the variable compression ratio engine control apparatus suppresses the compression pressure and improves fuel efficiency.

The internal combustion engine basically includes a cylinder head 1 and a cylinder block 2. The internal combustion engine is preferably a multi-cylinder engine.

However, for the sake of brevity, only one cylinder of the engine will be discussed and/or illustrated herein. For each cylinder of the engine, this engine includes a combustion chamber 4 defined by a portion of the cylinder block 2 above a piston 3 that is slideably disposed in the cylinder to reciprocate in a conventional manner.

Like other well-known engines, for each cylinder of the engine, this engine includes an intake valve 5 and an exhaust valve 6. The intake valve 5 opens and closes an intake port of an intake passage 7 where intake air enters the combustion chamber 4, while the exhaust valve 6 opens and closes an exhaust port of an exhaust passage 8 where exhaust exits the combustion chamber 4. The cylinder head 1 has a spark plug 9 for each cylinder of the engine. The spark plug 9 spark-ignites an air-fuel mixture inside the combustion chamber 4. Each cylinder of the engine also includes a fuel injection valve 10 associated with each combustion chamber 4. The intake valve 5 is operated by an intake cam 12 to open and close the intake port of the intake passage 7. The exhaust valve 6 is operated by an exhaust cam 13 to open and close the exhaust port of the exhaust passage 8. The fuel injection valve 10 serves as a fuel injection device or section that injects fuel to the intake passage 7 to supply fuel to the combustion chamber 4.

The engine further includes a control unit or control section 11 for controlling the combustion of the engine by controlling, among other things, the opening and closing timings of the intake valves 5 (only one shown), the opening and closing timings of the exhaust valves 6 (only one shown), the ignition timing of the spark plugs 9 (only one shown) and the injection timing of the fuel injection valves 10 (only one shown).

The upstream end of the intake passage 7 is connected to an intake air collector 14. A throttle 15 is provided on an upstream side of the intake air collector 14. The throttle 15 adjusts an intake air quantity by opening and closing the air passage entering the intake air collector 14. The control section 11 controls the opening and closing of the throttle 15 to adjust an intake air quantity provided to the combustion chambers 4 (only one shown). The engine also has a variable compression ratio device or section 20 that can vary an engine compression ratio. The control section 11 also controls the variable compression ratio device 20 as discussed below. The engine type is not limited to that shown in the FIG. 1. For example, the variable compression ratio engine control apparatus can also be applied to a direction fuel injection engine in which fuel is directly injected into the combustion chamber 4 of the engine by the fuel injection valve 10.

The control section 11 is a well-known digital computer (microcomputer) that includes, among other things, a CPU, a ROM, a RAM, and an input/output interface. The control section 11 constitutes an engine controller. The control section 11 receives various input signals. In particular, the control section 11 receives an air-fuel ratio sensor signal from an air-fuel ratio sensor 16 that detects an air-fuel ratio of exhaust gas. The control section 11 also receives a throttle sensor signal from a throttle sensor that detects a throttle opening degree. The control section 11 also receives a coolant temperature sensor signal from a coolant temperature sensor that detects an engine coolant temperature. The control section 11 also receives a crank angle sensor signal from a crank angle sensor that detects an engine rotational speed, a knock sensor signal from a knock sensor that detects whether or not knocking is occurring. The control section 11 also receives a rotational angle sensor signal from a variable compression ratio actuator 21 that drives a control shaft 27 of the variable compression ratio device 20 using electric power from a battery 17. The control section 11 also receives an engine load sensor signal from one or more sensors from which the engine load can be determined. Based on the input signals, the control section 11 sends control signals to the fuel injection valve 10, the spark plug 9, the throttle 15, the variable compression ratio actuator 21 of the variable compression ratio device 20, and other actuators so as to control a fuel injection quantity, a fuel injection timing, an ignition timing, a throttle opening degree, and an engine compression ratio.

Figure 2:
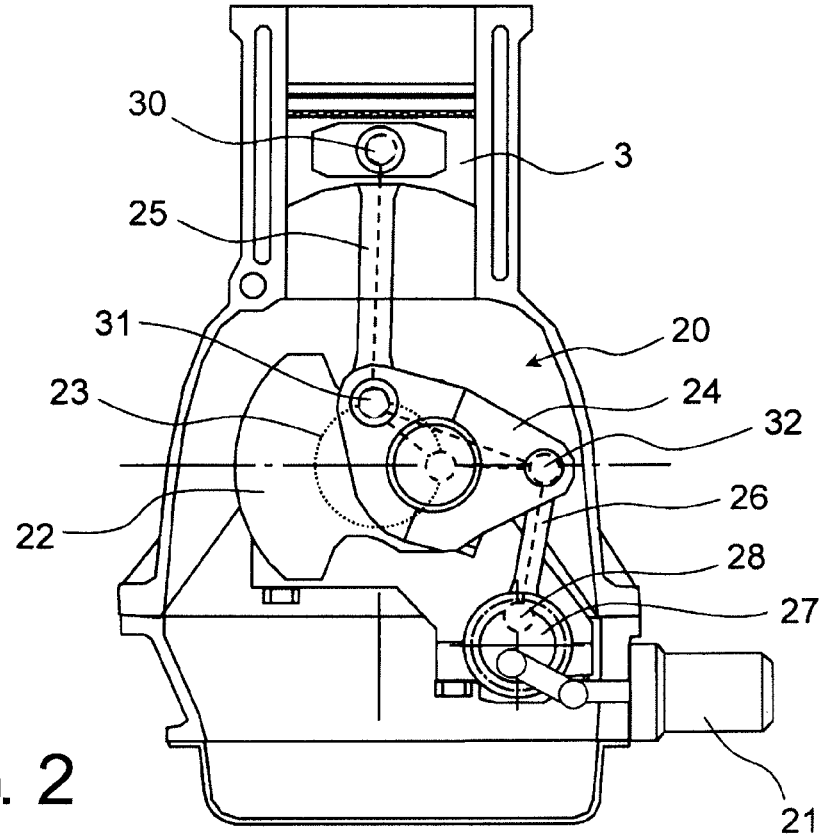
FIG. 2 is a cross sectional view of the variable compression ratio engine that is equipped with a variable compression ratio device of the first embodiment.
Figure 3:
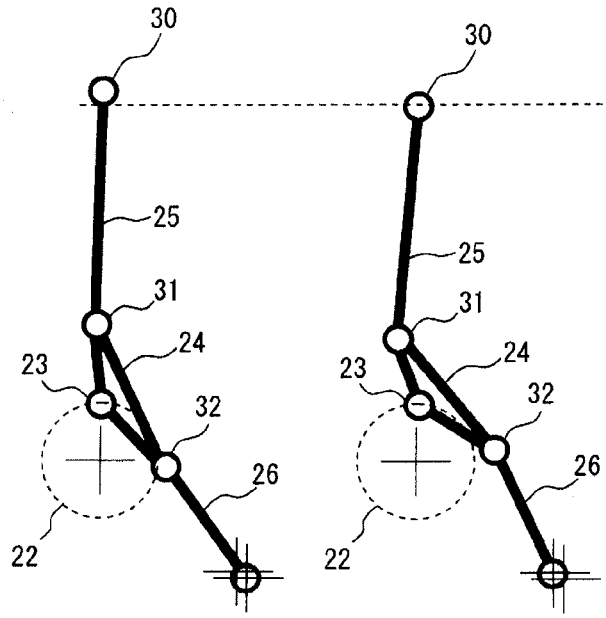
FIG. 3 a schematic link diagram of the variable compression ratio device showing a link orientation for a high compression ratio position (A) and a link orientation for a low compression ratio position (B)

As shown in FIGS. 2 and 3, the variable compression ratio device 20 utilizes a multiple-link piston-crank mechanism that includes a plurality of links arranged to join the piston 3 to a crankshaft 22 via a crank pin 23. The variable compression ratio device 20 has a lower link 24, an upper link 25 and a control link 26. The lower link 24 is rotatably attached to the crank pin 23. The upper link 25 connects the lower link 24 and the piston 3 together. The variable compression ratio device 20 has a control shaft 27 with an eccentric shaft section 28. The control link 26 connects the eccentric shaft section 28 and the lower link 24 together. One end of the upper link 25 is rotatably connected to the piston 3 by a piston pin 30. The other end of the upper link 25 is rotatably connected to the lower link 24 by a first connecting pin 31. One end of the control link 26 is rotatably is rotatably connected to a lower link 24 by a second connecting pin 32. The other end of the control link 26 is rotatably attached to the eccentric shaft section 28.

When the variable compression ratio actuator 21 changes a rotational position of the control shaft 27, the orientations of the control link 26 and the lower link 24 change as shown in FIG. 3. As a result, a piston movement (stroke characteristic) of the piston 3 changes. In other words, the variable compression ratio actuator 21 changes a rotational position of the control shaft 27 such that the top dead center position and the bottom dead center position of the piston 3 can be selectively changed. In this way, the engine compression ratio can be changed (controlled) in a continuously variable fashion.

Figure 4:
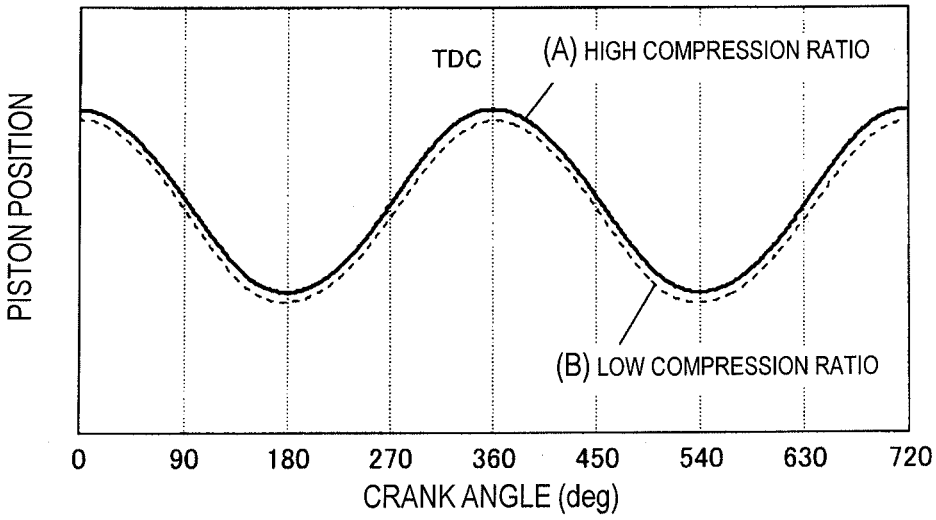
FIG. 4 is a characteristic diagram illustrating a piston motion occurring when the variable compression ratio device is in the high compression ratio position (A) and the low compression ratio position (B)

A variable compression ratio device 20 utilizing a multiple-link piston-crank mechanism like that just described can be used to correct an engine compression ratio in accordance with an engine operating state and to improve a fuel efficiency and output of the engine. Additionally, in comparison with a simple link mechanism in which the piston and the crank pin are connected with a single link, this variable compression ratio device 20 can correct the piston stroke characteristic (see FIG. 4) itself to, for example, a characteristic near simple harmonic motion. Also, compared to a single-link mechanism, a longer piston stroke can be achieved with respect to the crank throw, a total height dimension of the engine can be shortened, and a higher compression ratio can be achieved. Additionally, by adjusting a slope of the upper link 25, a thrust load acting on the piston 3 and the cylinder can be decreased and a more lightweight piston 3 and cylinder can be achieved. The variable compression ratio actuator 21 is not limited to an electric powered actuator. For example, it is acceptable to use a hydraulic drive device that uses a hydraulic pressure control valve.

Figure 5:
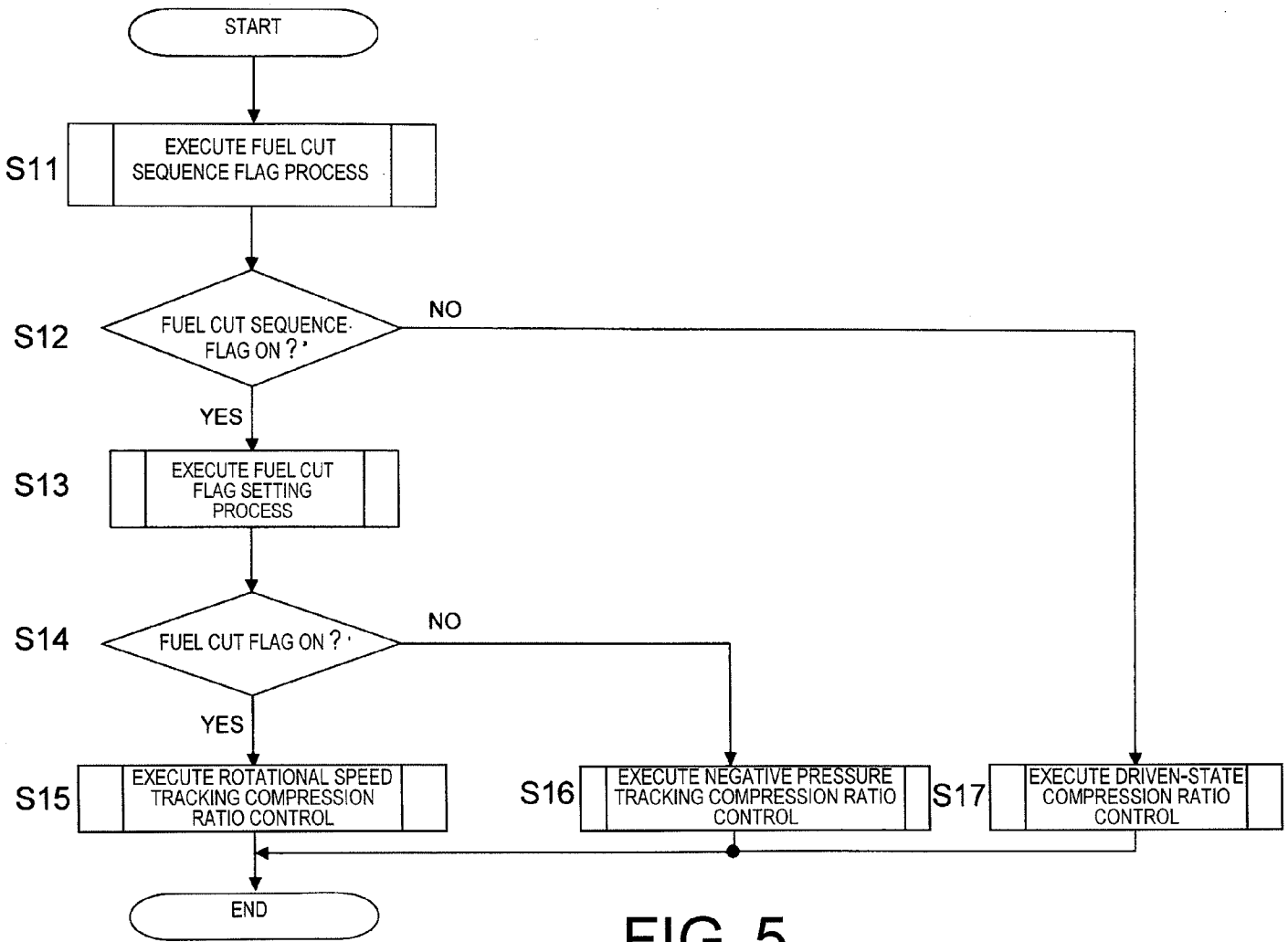
FIG. 5 is a flowchart showing a process executed by the variable compression ratio engine control apparatus such that the target compression ratio is set.

FIG. 5 is a flowchart showing steps of a control routine executed by the variable compression ratio engine control apparatus in this embodiment to set a target compression ratio when a fuel cut is executed. This control routine is repeatedly executed by the control section 11 once per prescribed amount of time (e.g., every 10 ms). With this control routine, during a fuel cut operating state, a compression pressure can be suppressed and wasteful energy consumption can be suppressed by setting the target compression ratio based on the engine rotational speed.

Figure 6:
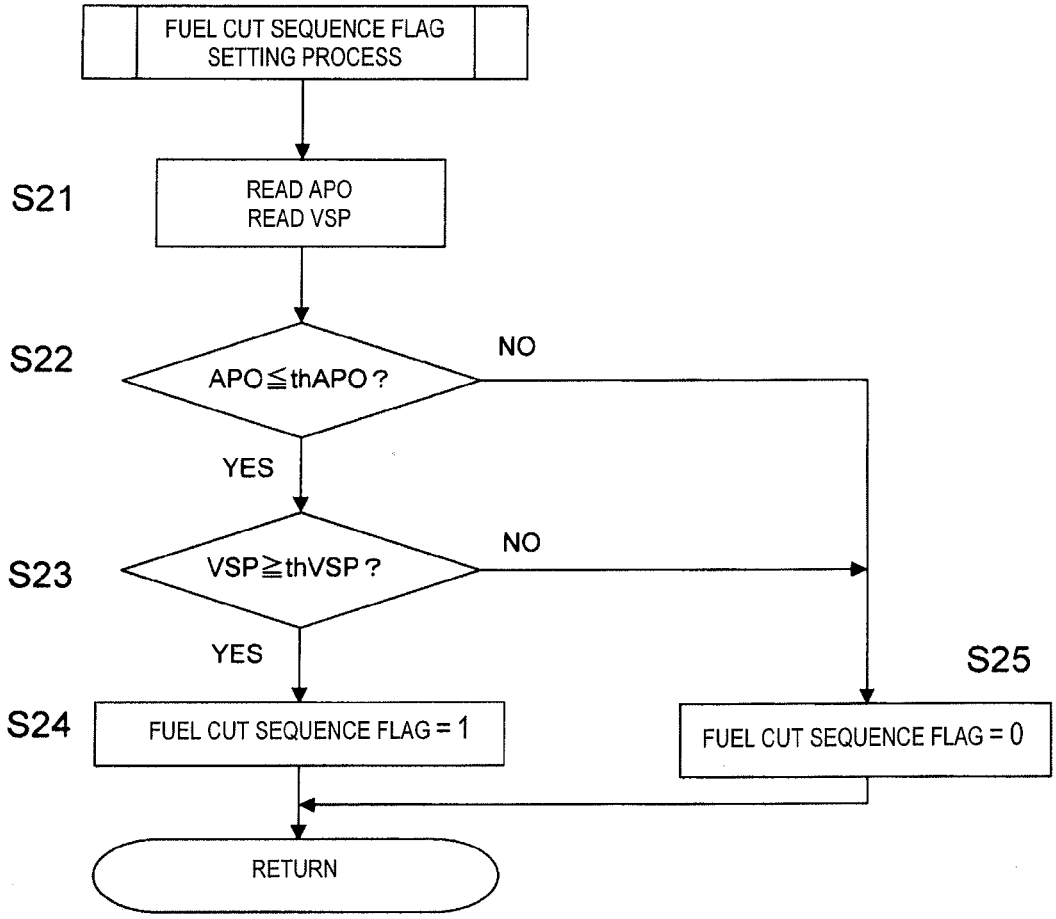
FIG. 6 is a flowchart showing a process executed by the variable compression ratio engine control apparatus for carrying out a fuel cut sequence flag setting process shown in FIG. 5.

In step S11, the control section 11 executes a subroutine shown in FIG. 6 to set a fuel cut sequence flag. The fuel cut sequence flag is set to "1" when the vehicle is in an operating state at which a fuel cut should be executed and set to "0" when the vehicle is not in an operating state at which a fuel cut should be executed. More specifically in step S21, the control section 11 reads an accelerator opening degree APO and a vehicle speed VSP, as shown in FIG. 6. If the control section 11 determines in step S22 that the accelerator opening degree APO is equal to or smaller than a prescribed value thAPO and determines in step S23 that the vehicle speed VSP is equal to or larger than a prescribed value thVSP, then the control section 11 proceeds to step S24. In step S24, the control section 11 sets the fuel cut sequence flag to "1" because the vehicle is in an operating state at which a fuel cut should be executed. Otherwise, the control section 11 proceeds to step S25. In step S25, the control section 11 sets the fuel cut sequence flag to "0" because the vehicle is not in an operating state at which a fuel cut should be executed. Thus, step S22 and step S23 constitute a first determining section that determines if a vehicle operating state exists that meets a prescribed condition in which a fuel cut operation is to be executed.

In step S12 of FIG. 5, the control section 11 determines if the fuel cut sequence flag has a value of "1." If the value of the fuel cut sequence flag is "1," then the control section 11 proceeds to step S13. However, if the vehicle is operating in a state at which a fuel cut should not be executed, then the control section 11 does not execute a fuel cut in response to a negative result in the determination process of step S12. The control section 11 then proceeds to step S17 and executes the driven-state compression ratio control shown in FIG. 10.

Figure 7:
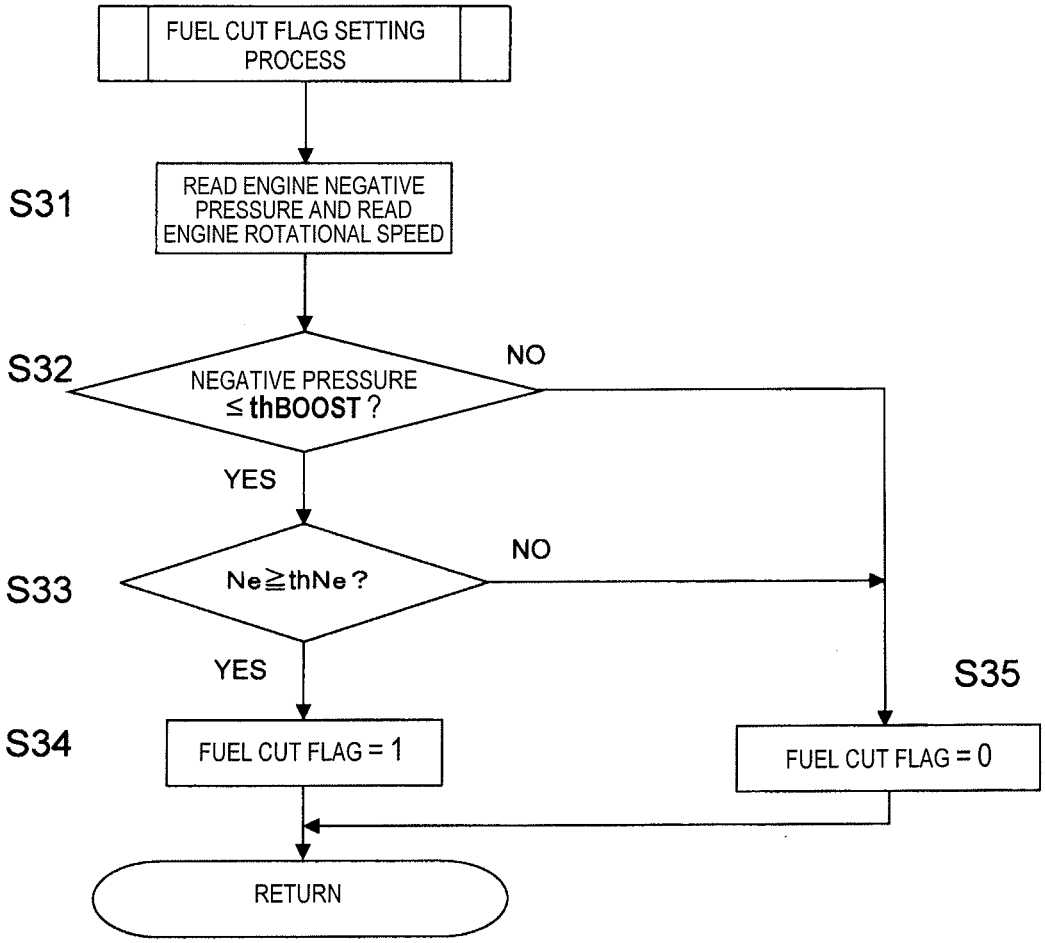
FIG. 7 is a flowchart showing a process executed by the variable compression ratio engine control apparatus for carrying out a fuel cut flag setting process shown in FIG. 5.

In step S13, the control section 11 executes a subroutine shown in FIG. 7 to set a fuel cut flag. The fuel cut flag is used to determine if the engine is in an operating state at which a fuel cut can be executed. The fuel cut flag is set to "1" if the engine is in an operating state at which a fuel cut can be executed and set to "0" if the engine is in an operating state at which a fuel cut cannot be executed. More specifically, in step S31 of FIG. 7, the control section 11 reads an engine pressure (negative pressure) and an engine rotational speed. If the control section 11 determines that the engine pressure (negative pressure) is equal to or smaller than a prescribed value thBoost (negative value) in step S32 and determines that the engine rotational speed is equal to or larger than a prescribed value thNE in step S33, then the control section 11 proceeds to step S34. In step S34, the control section 11 sets the fuel cut flag to "1" because the engine is operating in an operating state at which a fuel cut can be executed. Otherwise, the control section 11 proceeds to step S35. In step S35, the control section 11 sets the fuel cut flag to "0" because the engine is not in an operating state at which a fuel cut can be executed. Thus, step S32 and step S33 constitute a second determining section that determines if an engine operating state exists that meets a prescribed condition in which a fuel cut operation is to be executed.

In step S14 of FIG. 5, the control section 11 determines if the fuel cut flag has a value of "1." If the vehicle is operating in a state at which a fuel cut should be executed and the engine is operating in a state at which a fuel cut can be executed, then the control section 11 executes a fuel cut by stopping the injection of fuel in response to the affirmative results from the determination processes of steps S12 and S14. The control section 11 then proceeds to step S15. In step S15, the control section 11 executes the rotational speed tracking compression ratio control shown in FIG. 8.

However, if the vehicle is operating in a state at which a fuel cut should be executed but the engine is operating in a state at which a fuel cut is not possible, then a fuel cut is not executed, i.e., then the control section 11 keeps the engine running with normal fuel injection control. In other words, the control section 11 obtains an affirmative result from the determination process of step S12, but obtains a negative result from the determination process of step S14. Thus, the control section 11 then proceeds to step S16 and executes the negative pressure tracking compression ratio control shown in FIG. 9.

Figure 8:
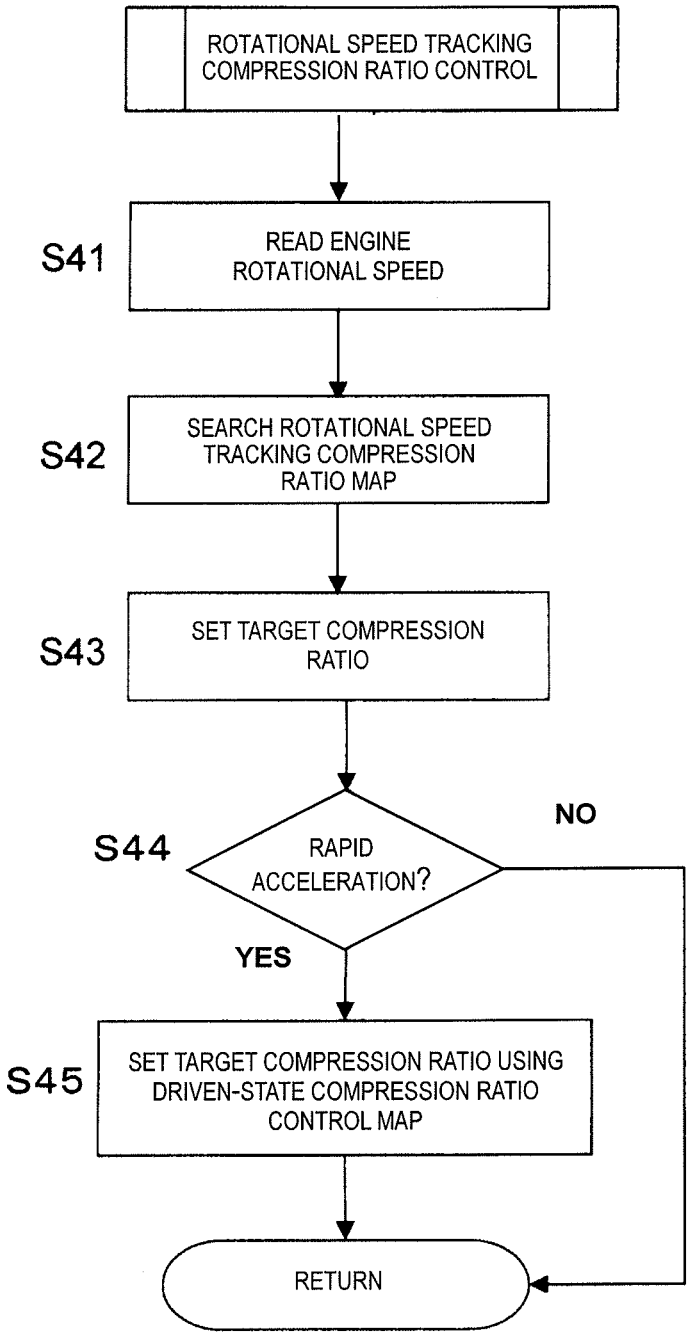
FIG. 8 is a flowchart showing a process executed by the variable compression ratio engine control apparatus for carrying out a rotational speed tracking compression ratio control shown in FIG. 5.
Figure 11:
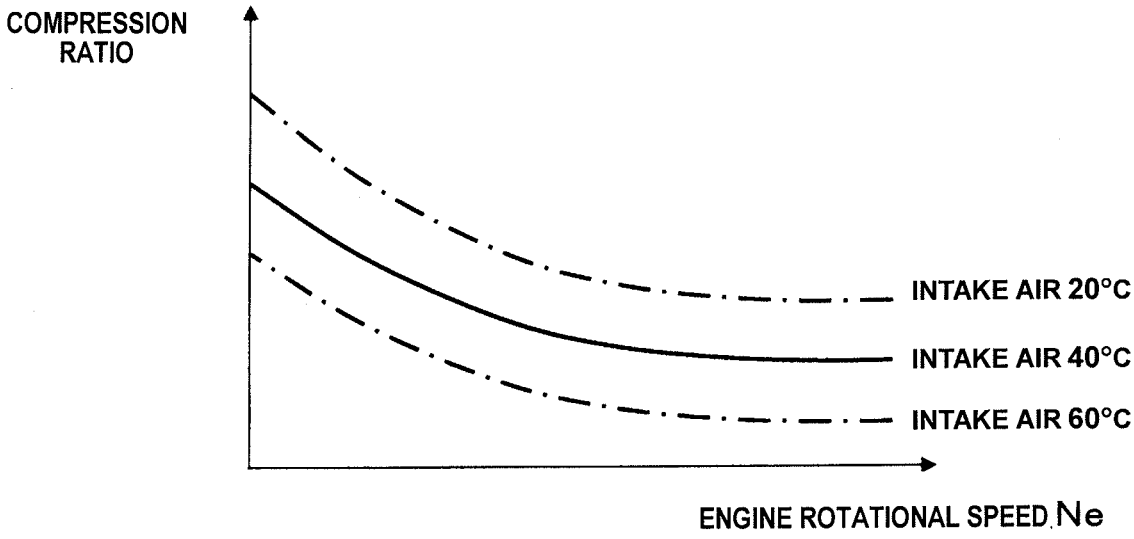
FIG. 11 shows a rotational speed tracking compression ratio control map used to set a target compression ratio during the rotational speed tracking compression ratio control.

The rotational speed tracking compression ratio control process will now be explained with reference to FIG. 8. In step S41, the control section 11 reads the engine rotational speed. In step S42, the control section 11 searches a pre-adapted or preset rotational speed tracking compression ratio control map, such as the one shown in FIG. 11 based on the read engine rotational speed and an intake air temperature. From this rotational speed tracking compression ratio control map, the control section 11 then sets a target compression ratio (step S43). As shown in FIG. 11, the target compression ratio is set lower at higher engine rotational speeds because there are more opportunities for ignition within the same period of time and the engine starting performance is good. Conversely, the target compression ratio is set higher at lower engine rotational speeds in order to ensure the engine starting performance (combustion stability). Meanwhile, the target compression ratio is set lower at higher intake air temperatures because the engine starting performance is good, and the target compression ratio is set higher at lower intake air temperatures because the engine starting performance degrades and a higher compression ratio helps ensure the engine starting performance.

That is, the target compression ratio is set based on the engine rotational speed and the intake air temperature to be as low as possible within a prescribed stable range where a good engine starting performance can be ensured. Setting the target compression ratio lower decreases the compression pressure and suppresses a pumping loss. As a result, a deceleration torque, i.e., engine braking, is suppressed. By regeneratively utilizing an amount of excess energy corresponding to the suppressed deceleration torque to operate an alternator (not shown) and generate electricity, a prescribed deceleration acceleration (engine braking) can be ensured while effectively recovering excess energy and improving fuel efficiency. Also, when, for example, the accelerator is not depressed and the vehicle is coasting due to inertia with the fuel supply cut, suppressing the deceleration torque as explained above serves to curb deceleration of the vehicle and extend a traveling distance of the vehicle, thereby improving the fuel performance.

Regarding the intake air temperature, it is acceptable to detect the intake air temperature directly by providing an intake air temperature sensor or to estimate it based on such parameters as the aforementioned engine coolant temperature and an engine oil temperature (hereinafter called "engine oil/coolant temperature"). If the engine oil/coolant temperature is used instead of the aforementioned intake air temperature, then the target compression ratio is set lower than as the engine oil/coolant temperature increases.

In step S44, the control section 11 determines if there is a possibility that a rapid acceleration will occur and changes/corrects the target compression ratio according to the result of the determination. The determination regarding the possibility of a rapid acceleration is made, for example, based on a change rate (increase rate) of an accelerator opening degree or based on information obtained from a well-known vehicle navigation system. More specifically, if the accelerator opening degree is increasing at a rate exceeding a prescribed value or if information from the vehicle navigation system indicates that a road ahead will change from a descending slope or a flat road to an ascending slope, then the control section 11 determines that there is a possibility of a rapid acceleration occurring.

If it determines that there is a possibility that a rapid acceleration will occur, then the control section 11 proceeds from step S44 to step S45. In step S45, the control section 11 sets the target compression ratio by referring to a driven-state compression ratio control map such as the one shown in FIG. 13. The driven-state compression ratio control map is used for setting a target compression ratio when the engine is in an actual running state in which a fuel cut is not executed. Thus, in step S45, the control section 11 determines the target compression ratio based on a current engine rotational speed and an engine load corresponding to a fully open output (NA-WOT). That is, if it determines there is a possibility that a rapid acceleration will occur, then, in preparation for an anticipated restart of the engine, the control section 11 sets the target compression ratio using the driven-state (engine actually running state) compression ratio control map such that the target compression ratio adjusted in advance to a value closer to a value used when the engine is actually running. In this way, unnecessary changes to the compression ratio can be suppressed and the amount by which the compression ratio is changed when the engine is restarted can be reduced by setting the target compression ratio in advance to a value closer to a value that will be used when the engine is restarted. As a result, a response characteristic can be improved and a sudden (abrupt) torque change can be suppressed. Also, by setting the target compression ratio based on an engine load corresponding to a fully open output (NA-WOT), the occurrence of knocking and pre-ignition caused by an excessively high compression ratio can be reliably reduced or avoided.

Figure 9:
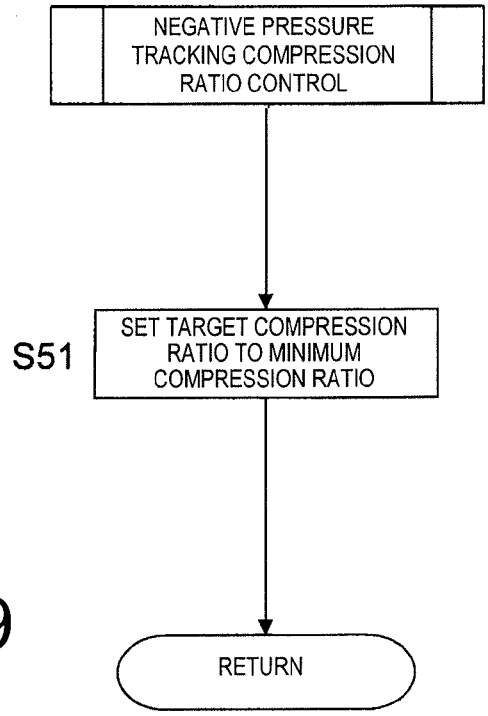
FIG. 9 is a flowchart showing a process executed by the variable compression ratio engine control apparatus for carrying out a negative pressure tracking compression ratio control shown in FIG. 5.

The negative pressure tracking compression ratio control process shown in FIG. 9 is executed when the vehicle is operating in a state in which a fuel cut should be executed, but the engine is operating in a state in which it is not possible to execute a fuel cut. Thus, this control is executed during a transient period when the vehicle is changing from an operating state in which a fuel cut is not executed, i.e., an engine operating state in which fuel injection is being executed to supply fuel to the engine, to a state in which a fuel cut is executed. In step S51 of the negative pressure tracking compression ratio control process, the control section 11 sets the target compression ratio to a low value in advance before a fuel cut is executed. More particularly, in this embodiment, the control section 11 sets the target compression ratio to a minimum compression ratio Emin.

Figure 12:
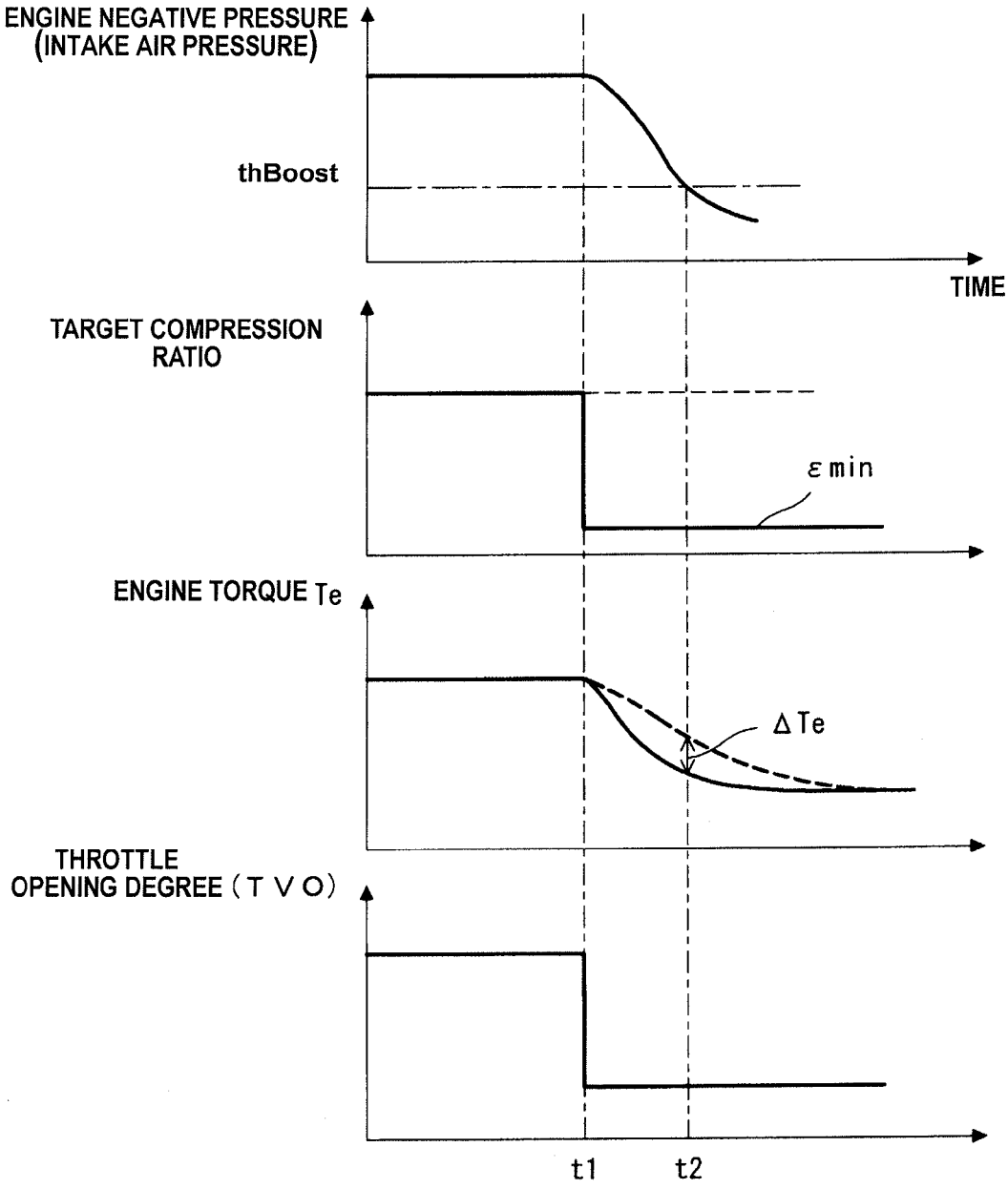
FIG. 12 is a timing chart showing how the target compression ratio and other parameters vary during the negative pressure tracking compression ratio control.

Operational effects of the negative pressure tracking compression ratio control processing will now be explained with reference to FIG. 12. When the vehicle is traveling at a vehicle speed equal to or higher than a prescribed value Ne and a driver releases the accelerator pedal such that the vehicle decelerates, at a time t1 shown in FIG. 12 the accelerator opening degree becomes equal to or smaller than a prescribed value thAPO (see step S22 of FIG. 6) and the fuel cut sequence flag is set to "1," i.e., the vehicle enters an operating state in which a fuel cut should be executed. Then, at a time t2, the engine pressure has decreased (a negative pressure develops) to a prescribed value thBoost and the fuel cut flag is set to "1." Execution of the fuel cut begins. The negative pressure following compression ratio control is executed during the period from the time t1 to the time t2.

At the time t1 when the vehicle enters an operating state at which a fuel cut should be executed, even if a throttle opening degree TVO decreases in response to the decrease of the accelerator opening degree, a response delay of the intake air remaining in the intake air collector will have the effect of preventing the engine negative pressure from decreasing rapidly. Consequently, as indicated by the broken-line characteristic curve in the figure, there is a possibility that the engine torque will be high and a sudden torque change will occur at the time t2 when the fuel cut starts. However, in this embodiment, a decrease of the engine torque is accelerated by decreasing the target compression ratio to a minimum compression ratio $\epsilon$min as indicated by the solid-line characteristic curve in the figure. Thus, the engine torque at the time t2 when the fuel cut starts can be reduced by a prescribed amount $\Delta$Te in comparison with the broken-line characteristic (in which the target compression ratio is not revised) shown in the figure. By decreasing the target compression ratio before the fuel cut is executed, a sudden torque change occurring when the engine is restarted can be reduced or eliminated.

Although in this embodiment the negative pressure tracking compression ratio control decreases the target compression ratio to the minimum compression ratio εmin, the invention is not limited to using a minimum compression ratio. For example, it is acceptable for the target compression ratio to be decreased by an adjustment amount corresponding to the engine negative pressure. More specifically, since the engine torque decreases and the sudden torque change decreases as the engine pressure decreases (as the negative pressure develops), it is acceptable to decrease the adjustment amount and use a larger target compression ratio as the engine pressure decreases.

Figure 10:
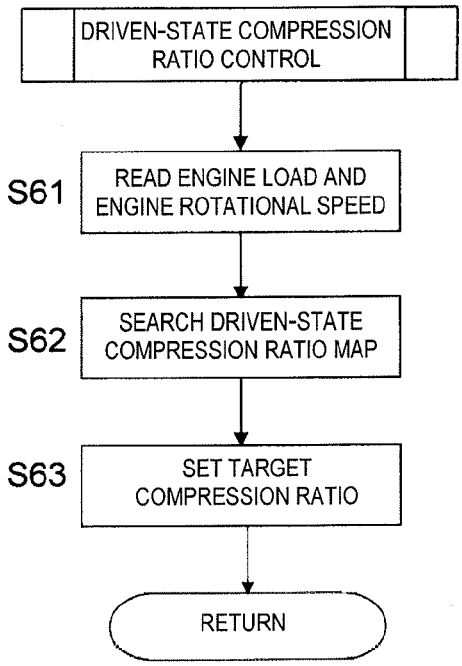
FIG. 10 is a flowchart showing a process executed by the variable compression ratio engine control apparatus for carrying out a driven-state compression ratio control shown in FIG. 5.
Figure 13:
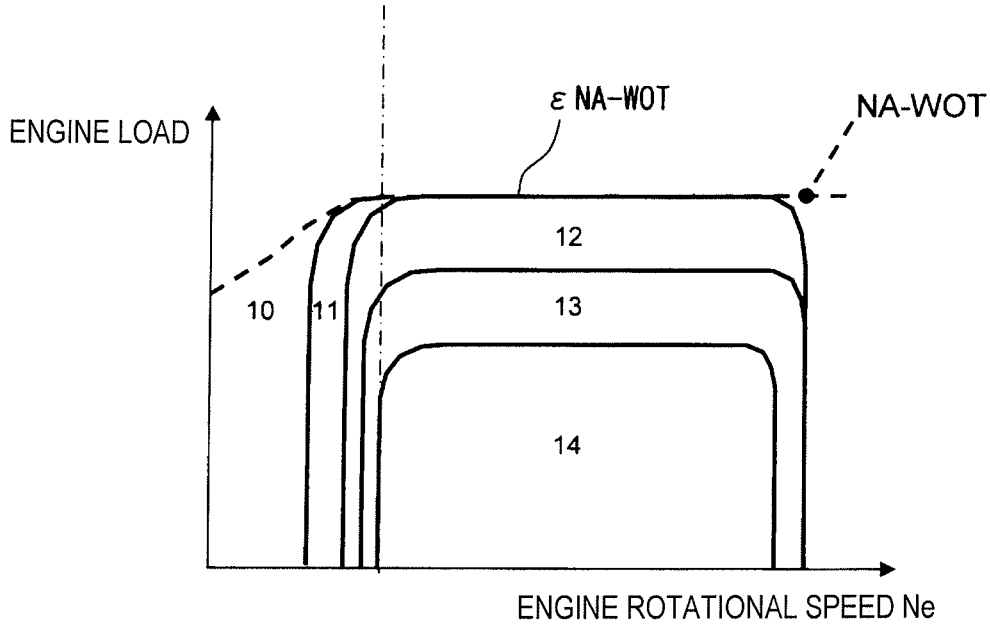
FIG. 13 shows a driven-state compression ratio control map used to set a target compression ratio during the driven-state compression ratio control.

The aforementioned driven-state compression ratio control will now be explained with reference to FIG. 10. In step S61, the control section 11 reads the engine load and the engine rotational speed Ne. In step S62, the control section 11 searches a pre-adapted or preset driven-state compression ratio control map like that shown in FIG. 13 based on the read engine load and engine rotational speed and then sets a target compression ratio (step S63). As shown in FIG. 13, the target compression ratio is basically set to a higher value when the engine load is lower in order to increase an effective compression ratio and improve the fuel efficiency. In a low speed region where the engine rotational speed Ne is low, the target compression ratio is held to a low value (10 in the example shown in the figure) to avoid an occurrence of pre-ignition. In a high load region in a vicinity of a fully open output (NA-WOT), the target compression ratio is held to a low value (11 or 12 in the example shown in the figure) to avoid an occurrence of knocking.

The driven-state compression ratio control map shown in FIG. 13 is used to set the target compression ratio when the engine is running in the normal manner with fuel supplied by fuel injection, but driven-state compression ratio control map is also used in this embodiment to set the target compression ratio when there is a possibility that a rapid acceleration will occur during a fuel cut state. Thus, the amount of memory consumed can be reduced in comparison with a control apparatus in which a separate control map is established for each individual situation.

In understanding the scope of the present invention, the terms "determine" and "determining" as used herein to describe an operation or function carried out by a component, a section, a device or the like includes a component, a section, a device or the like that does not require physical detection, but rather includes actually (physically) measuring as well as estimating, modeling, predicting or computing or the like to carry out the operation or function. The terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A variable compression ratio engine control apparatus comprising:

a fuel injection device that injects fuel into an engine for combustion;

a variable compression ratio device that varies an engine compression ratio of the engine;

a target compression ratio setting section that sets a target compression ratio;

an operating state determining section that determines if an operating state exists that meets a prescribed condition for a fuel cut operating state in which a fuel cut operation is to be executed to stop fuel injection by the fuel injection device; and a compression ratio controlling section that controls the engine compression ratio toward the target compression ratio, the target compression ratio setting section setting the target compression ratio based on an engine rotational speed during the fuel cut operating state, the target compression ratio setting section setting the target compression ratio when the operating state determining section determines that the operating state exists for the fuel cut operating state differently than when the operating state determining section determines that the operating state does not exist for the fuel cut operating state, the target compression ratio setting section setting the target compression ratio to a lower value as the engine rotational speed becomes higher during the fuel cut operating state.

2. The variable compression ratio engine control apparatus according to claim 1, wherein the target compression ratio setting section sets the target compression ratio based on the engine rotational speed to be as low as possible within a prescribed stable range during the fuel cut operating state upon determining the engine is to be restarted again.

3. The variable compression ratio engine control apparatus according to claim 1, wherein the target compression ratio setting section sets the target compression ratio to a lower value as an intake air temperature or an oil/coolant temperature becomes higher regardless of the engine rotational speed, during the fuel cut operating state.

4. The variable compression ratio engine control apparatus according to claim 1, wherein the target compression ratio setting section further sets the target compression ratio based on an engine load in conjunction with the engine rotational speed using a preset driven-state compression ratio control map during a normal fuel injection control by the fuel injection device; and the target compression ratio setting section sets the target compression ratio based on a current engine rotational speed and the engine load corresponding to a fully open output using the driven-state compression ratio control map during the fuel cut operating state upon the target compression ratio setting section determining conditions exist such that a rapid acceleration of the engine will likely occur.

5. The variable compression ratio engine control apparatus according to claim 1, wherein the operating state determining section includes a first determining section that determines if a vehicle operating state exists that meets a prescribed condition in which the fuel cut operation is to be executed, and a second determining section that determines if an engine operating state exists that meets a prescribed condition for executing the fuel cut operation, the target compression ratio setting section being further configured to lower in advance the target compression ratio before the fuel cut operation is executed upon the first determining section determining that the vehicle operating state exists for executing the fuel cut operation and upon the second determining section determining that the engine operating state does not exist for executing the fuel cut operation.

6. A variable compression ratio engine control apparatus comprising:

fuel injection means for injecting fuel into an engine for combustion;

variable compression ratio means for varying an engine compression ratio;

target compression ratio setting means for setting a target compression ratio based on an engine rotational speed during a fuel cut operating state in which a fuel cut operation is to be executed to stop fuel injection by the fuel injection means;

operating state determining means for determining if an operating state exists that meets a prescribed condition for the fuel cut operating state; and compression ratio controlling means for controlling the engine compression ratio toward the target compression ratio, the target compression ratio setting means setting the target compression ratio when the operating state determining means determines that the operating state exists for the fuel cut operating state differently than when the operating state determining means determines that the operating state does not exist for the fuel cut operating state, the target compression ratio setting means setting the target compression ratio to a lower value as the engine rotational speed becomes higher during the fuel cut operating state.

7. A variable compression ratio engine control method comprising:

controlling an engine compression ratio of an engine;

setting a target compression ratio based on an engine rotational speed during a fuel cut operating state in which a fuel cut operation is to be executed to stop fuel injection into the engine for combustion;

determining if an operating state exists that meets a prescribed condition for the fuel cut operating state; and further controlling the engine compression ratio of the engine toward the target compression ratio during the fuel cut operating state, the setting of the target compression ratio including setting the target compression ratio upon determining that the operating state exists for the fuel cut operating state differently than upon determining that the operating state does not exist for the fuel cut operating state, the setting of the target compression ratio further including setting the target compression ratio to a lower value as the engine rotational speed becomes higher during the fuel cut operating state.

* * * * *